US009568849B2

(12) United States Patent
Imai et al.

(10) Patent No.: US 9,568,849 B2
(45) Date of Patent: Feb. 14, 2017

(54) LIQUID DEVELOPER, DEVELOPER CARTRIDGE, AND IMAGE FORMING APPARATUS

(71) Applicant: FUJI XEROX CO., LTD., Tokyo (JP)

(72) Inventors: Akira Imai, Kanagawa (JP); Koji Horiba, Kanagawa (JP); Daisuke Yoshino, Kanagawa (JP); Takako Kobayashi, Kanagawa (JP); Masahiro Oki, Kanagawa (JP); Yoshitake Ogura, Kanagawa (JP); Hiroyuki Moriya, Kanagawa (JP); Yoshihiro Inaba, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/830,029

(22) Filed: Aug. 19, 2015

(65) Prior Publication Data

US 2016/0202626 A1 Jul. 14, 2016

(30) Foreign Application Priority Data

Jan. 9, 2015 (JP) ..... 2015-002979

(51) Int. Cl.
*G03G 9/13* (2006.01)
*G03G 9/125* (2006.01)

(52) U.S. Cl.
CPC ..... *G03G 9/132* (2013.01); *G03G 9/125* (2013.01)

(58) Field of Classification Search
CPC ..... G03G 9/12; G03G 9/125; G03G 9/131
See application file for complete search history.

(56) References Cited

U.S. PATENT DOCUMENTS

| | | | | |
|---|---|---|---|---|
| 5,672,456 | A * | 9/1997 | Chamberlain | G03G 9/135 430/115 |
| 5,783,349 | A | 7/1998 | Spiewak et al. | |
| 2010/0196817 | A1* | 8/2010 | Sasaki | G03G 9/0819 430/109.4 |
| 2011/0177448 | A1* | 7/2011 | Ueno | G03G 9/125 430/112 |

FOREIGN PATENT DOCUMENTS

| | | | |
|---|---|---|---|
| JP | H01-211771 | A | 8/1989 |
| JP | H11-72971 | A | 3/1999 |
| JP | 2003-149872 | A | 5/2003 |
| JP | 2010-204243 | A | 9/2010 |

* cited by examiner

*Primary Examiner* — Peter Vajda
(74) *Attorney, Agent, or Firm* — Oliff PLC

(57) ABSTRACT

A liquid developer contains a carrier liquid and a toner particle which contains a binder resin, wherein the toner particles have a content of aluminum measured by fluorescent X-ray analysis in a range of from 0.04% by weight to 0.1% by weight of total elements.

10 Claims, 1 Drawing Sheet

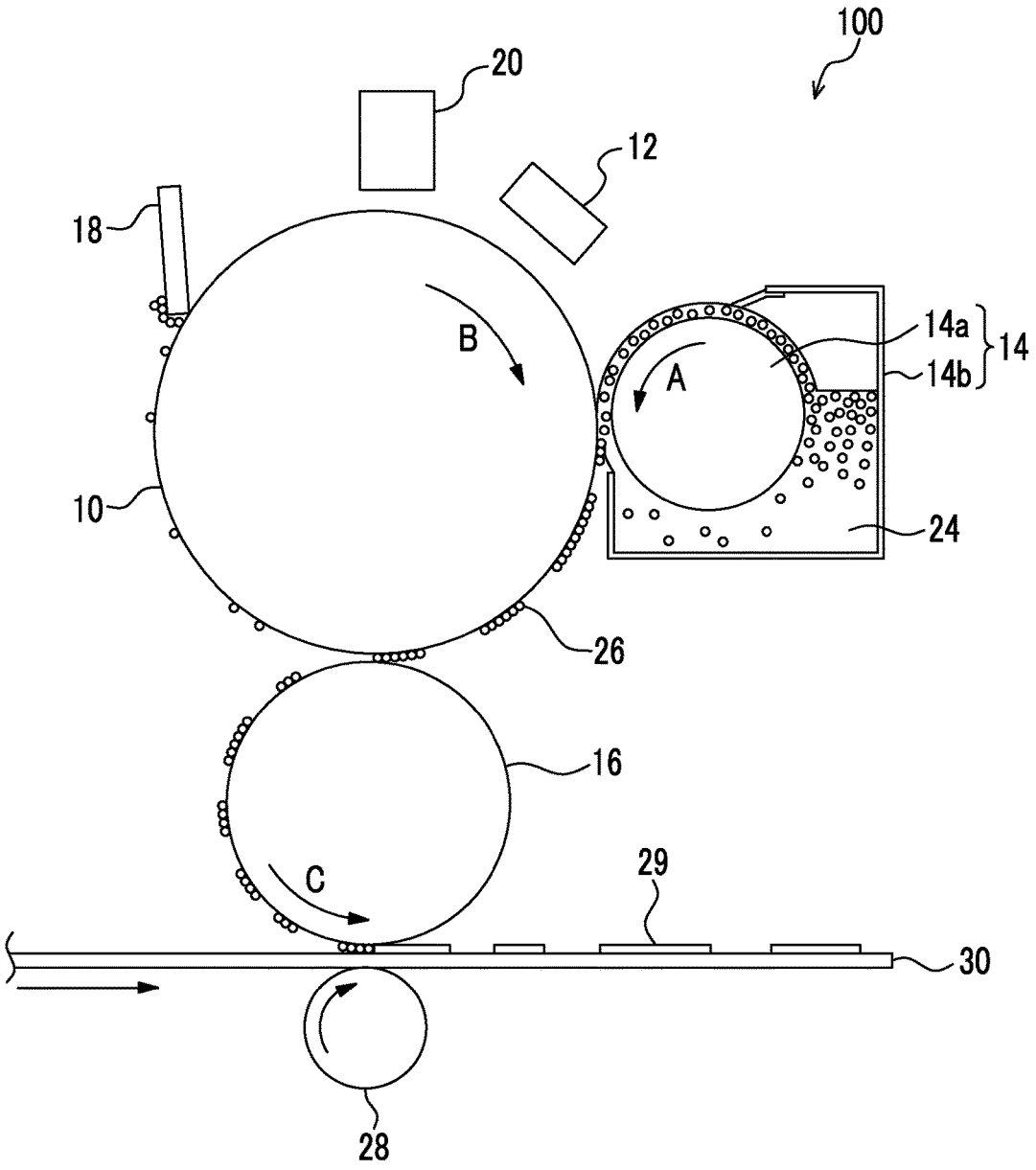
100
20
12
18
B
A
14a
14
14b
10
24
26
16
C
29
30
28

LIQUID DEVELOPER, DEVELOPER CARTRIDGE, AND IMAGE FORMING APPARATUS

CROSS-REFERENCE TO RELATED APPLICATIONS

This application is based on and claims priority under 35 USC 119 from Japanese Patent Application No. 2015-002979 filed Jan. 9, 2015.

BACKGROUND

1. Technical Field

The present invention relates to a liquid developer, a developer cartridge, and an image forming apparatus.

2. Related Art

A method of visualizing image information through an electrostatic charge image such as an electrophotography method is currently used in many fields. In the electrophotography method, a latent image (electrostatic latent image) is formed on an image holding member in charging and exposing processes (latent image forming process), and the latent image is visualized by developing an electrostatic latent image with a developer for developing an electrostatic charge image (hereinafter, also simply referred to as a "developer") including a toner for developing an electrostatic charge image (hereinafter, also simply referred to as a "toner") (developing process), and performing a transfer process and a fixing process. As a developer used in a dry development method, a two-component developer made with a toner and a carrier, and a single component developer in which a magnetic toner or a non-magnetic toner is singly used are included.

Meanwhile, a liquid developer used in a wet development method is obtained by dispersing toner particles in an insulating carrier liquid. A type in which toner particles including a thermoplastic resin are dispersed in a volatile carrier liquid, a type in which toner particles including a thermoplastic resin are dispersed in a hardly volatile carrier liquid, and the like are known.

SUMMARY

According to an aspect of the invention, there is provided a liquid developer including:

a carrier liquid; and a toner particle which contains a binder resin, wherein the toner particles has a content of aluminum measured by fluorescent X-ray analysis in a range of from 0.04% by weight to 0.1% by weight of total elements.

BRIEF DESCRIPTION OF THE DRAWINGS

Exemplary embodiments of the present invention will be described in detail based on the following FIGURE, wherein:

FIG. 1 is a configuration view schematically illustrating an example of an image forming apparatus according to an exemplary embodiment.

DETAILED DESCRIPTION

Exemplary embodiments of the invention are described below. The exemplary embodiments are provided as examples implementing the invention, and the invention is not limited thereto.

Liquid Developer

A liquid developer of the exemplary embodiment contains a carrier liquid and a toner particle including a binder resin. In the liquid developer according to the exemplary embodiment, the content of aluminum in toner particles measured by fluorescent X-ray analysis is in the range of from 0.04% by weight to 0.1% by weight of total elements.

In the liquid developer in which toner particles including a binder resin are dispersed in the carrier liquid, it has been difficult to preferably maintain charging characteristics of a toner. In the exemplary embodiment of the invention, a liquid developer whose charge maintaining properties are improved is obtained by employing toner particles in which the content of aluminum in toner particles measured by fluorescent X-ray analysis is in the range of from 0.04% by weight to 0.1% by weight of total elements as the toner particles in the liquid developer in which toner particles including a binder resin are dispersed in the carrier liquid.

Although the detailed principles of improvement in charge maintaining properties when the liquid developer according to the exemplary embodiment is used is not clear, but it is considered that aluminum (for example, aluminum oxide or a complex compound of aluminum) contained in the toner particles (particularly, in the vicinity of the surface of toner particles) contributes to an increase in dielectric constant.

The content of aluminum in toner particles measured by fluorescent X-ray analysis is in the range of from 0.04% by weight to 0.1% by weight of total elements. When the content of aluminum in toner particles measured by fluorescent X-ray analysis is out of the range of from 0.04% by weight to 0.1% by weight of total elements, the charge maintaining properties are deteriorated.

Hereinafter, constituent components of the liquid developer according to the exemplary embodiment will be described in detail.

Toner Particles

Toner particles contained in the liquid developer according to the exemplary embodiment contains a binder resin and may contain other components such as a colorant and a release agent if necessary. The surface of the toner particles may be treated by polyamines. In a case where the positive charging properties are provided for the liquid developer, the toner particles whose surface is treated by polyamines may be used. Further, in a case where the negative charging properties are provided for the liquid developer, the toner particles whose surface is not treated by polyamines may be used.

Examples of the polyamine include polyalkyleneimines, polyallylamines, and polydiallylamines. Among these, polyalkyleneimines and polyallylamines are preferable in terms that polyalkyleneimines and polyallylamines are highly cationic and easily positively charged.

As the polyalkyleneimines, polyethyleneimine is exemplified.

As the polyallylamines, polyallylamines represented by the following formula (I) are exemplified.

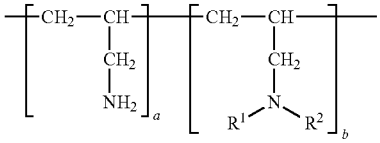

(I)

(In the formula (I), $R^1$ and $R^2$ each independently represent a hydrogen atom or an aliphatic hydrocarbon group having 1 to 20 carbon atoms and a and b each independently represent an integer of 100 to 1,000.)

$R^1$ and $R^2$ each independently represent a hydrogen atom or an aliphatic hydrocarbon group having 1 to 20 carbon atoms and an aliphatic hydrocarbon group having 1 to 20 carbon atoms is preferable. Examples of the aliphatic hydrocarbon group having 1 to 20 carbon atoms include a methyl group, an ethyl group, a linear or branched propyl group, a butyl group, a pentyl group, a hexyl group, and an octyl group. Among these, a methyl group is preferable.

a and b each independently represent an integer of 1 to 10,000 and an integer of 5 to 1,000 is preferable.

The amount of the polyamines with respect to the toner particles is preferably in the range of from 0.01 parts by weight to 100 parts by weight and more preferably in the range of from 0.1 parts by weight to 10 parts by weight with respect to 100 parts by weight of the toner particles. When the amount of the polyamines with respect to the toner particles is less than 0.01 parts by weight with respect to 100 parts by weight of the toner particles, charging properties may be deteriorated. When the amount thereof exceeds 100 parts by weight, the conductivity of the developer is extremely high and this may lead to deterioration of charging properties.

The weight average molecular weight of polyamines is preferably in the range of from 100 to 1,000,000, more preferably in the range of from 1,000 to 100,000. When the weight average molecular weight of the polyamines is less than 100, absorptivity to the surface of the toner is deteriorated and thus target charging performance may not be obtained. When the weight average molecular weight exceeds 1,000,000, the toner particles may be adhered to each other.

Binder Resin

The binder resin preferably contains a polyester resin as a main component. The polyester resin is obtained by synthesizing an acid (polyvalent carboxylic acid) component and an alcohol (polyvalent alcohol) component. According to the exemplary embodiment, an "acid-derived structural component" refers to a structural portion which is an acid component before a polyester resin is synthesized, and an "alcohol-derived structural component" refers to a structural portion which is an alcohol component before the polyester resin is synthesized. A main component refers to a component that is equal to or greater than 50 parts by weight with respect to 100 parts by weight of the binder resin in the toner particles.

Acid-Derived Structural Component

The acid-derived structural component is not particularly limited, and an aliphatic dicarboxylic acid and an aromatic carboxylic acid are preferably used. As the aliphatic dicarboxylic acid, for example, oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid, and 1,18-octadecanedicarboxylic acid, or lower alkyl esters thereof or acid anhydrides thereof are included, but the invention is not limited thereto. In addition, as the aromatic carboxylic acid, for example, lower alkyl esters or acid anhydrides of an aromatic carboxylic acid such as terephthalic acid, isophthalic acid, anhydrous phthalic acid, anhydrous trimellitic acid, pyromellitic acid, and naphthalin dicarboxylic acid are included. In addition, an alicyclic carboxylic acid such as cyclohexanedicarboxylic acid is included. Further, it is preferable to use carboxylic acids of trivalent or higher (trimellitic acids or acid anhydrides thereof) together with the dicarboxylic acid in order to obtain a crosslinked structure or a branched structure for securing good fixing properties. In addition, specific examples of alkenylsuccinic acids described above include dodecenylsuccinic acid, dodecylsuccinic acid, stearylsuccinic acid, octylsuccinic acid, octenylsuccinic acid, and the like.

Alcohol-Derived Structural Component

The alcohol-derived structural component is not particularly limited, and aliphatic diol, for example, ethyleneglycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, 1,20-eicosanediol are included. In addition, diethyleneglycol, triethyleneglycol, neopentylglycol, glycerin, alicyclicdiols such as cyclohexanediol, cyclohexanedimethanol and hydrogenated bisphenol A, and aromatic diols such as an ethylene oxide adduct of bisphenol A and a propylene oxide adduct of bisphenol A are used. In addition, in order to obtain a crosslinked structure or a branched structure for securing good fixing properties, polyvalent alcohol of trivalent or higher (glycerin, trimethylolpropane, pentaerythritol) may be used together with diol.

The method of preparing the polyester resin is not particularly limited, and the polyester resin may be prepared in a general polyester polymerization method in which an acid component and an alcohol component are reacted. For example, direct polycondensation and an ester exchanging method are included, and the preparation method may be used depending on types of monomers. When the acid component and the alcohol component are reacted, a molar ratio (acid component/alcohol component) is different depending on reaction conditions, but is generally about 1/1.

The polyester resin may be prepared in the temperature range of from 180° C. to 230° C., and the reaction may be performed while the reaction system is decompressed, and water or alcohol generated at the time of the condensation is removed, if necessary. If the monomer is not dissolved or compatible under the reaction temperature, a polymerization reaction becomes partially fast or slow so as to form a lot of uncolored particles. Therefore, a medium with a high boiling point may be added and dissolved as a solubilizing agent.

The polycondensation reaction may be performed while a solubilizing solvent is distilled. In the copolymerization reaction, if a poorly compatible monomer exists, the poorly compatible monomer and acid or alcohol to be polycondensed with the monomer are condensed in advance, and then the polycondensation is performed with the main component.

As the catalyst to be used at the time of preparing the polyester resin, an alkali metal compound such as sodium and lithium; an alkaline-earth metal compound such as magnesium or calcium; a metal compound such as zinc, manganese, antimony, titanium, tin, zirconium, or germanium; a phosphoric acid compound, a phosphorous acid compound, and an amine compound, and the like are included. Among them, for example, a tin containing catalyst such as tin, formic acid tin, oxalic acid tin, tetraphenyl tin, dibutyltin dichloride, dibutyltin oxide, or diphenyltin oxide is preferably used.

According to the exemplary embodiment, as a resin for an electrostatic charge image developing toner, a compound with a hydrophilic polar group is used, as long as the compound may be copolymerized. Specifically, if the used resin is polyester, a dicarboxylic acid compound in which a sulphonyl group is directly substituted for an aromatic ring such as sulphonyl-terephthalic acid sodium salt, and 3-sulphonyl isophthalic acid sodium salt are included.

A weight average molecular weight Mw of the polyester resin is preferably equal to or greater than 5,000, and more preferably in the range of from 5,000 to 50,000. If the polyester resin is included, friction sliding properties are superior.

If the weight average molecular weight Mw of the polyester resin is less than 5,000, the polyester resin is easily separated, and thus problems caused by isolated resins (filming, increase of fine powders caused by fragility, deterioration of powder flow characteristic, and the like) may occur depending on the circumstances.

The weight average molecular weight (Mw) of a binder resin or the like is measured by a gel permeation chromatography (GPC). Measurement of the molecular weight using GPC is performed in a THF solvent using GPC•HLC-8120 (manufactured by Tosoh Corporation) as a measuring device and column TSKGEL SUPERHM-M (15 cm) (manufactured by Tosoh Corporation). The weight average molecular weight is calculated using a molecular weight calibration curve created by a monodisperse polystyrene standard sample from the measurement results.

The toner according to the exemplary embodiment may contain a resin other than a polyester resin. The resin other than the polyester resin is not particularly limited, and specifically, styrenes such as styrene, p-chlorostyrene, or α-methylstyrene; an acryl monomer such as methyl acrylate, ethyl acrylate, n-propyl acrylate, butyl acrylate, lauryl acrylate, or 2-ethylhexyl acrylate; a methacryl monomer such as methyl methacrylate, ethyl methacrylate, n-propyl methacrylate, lauryl methacrylate, or 2-ethylhexyl methacrylate; an ethylene unsaturated acid monomer such as acrylate, methacrylate, or styrenesulfonic acid sodium; vinyl nitriles such as acrylonitrile or methacrylonitrile; vinyl ethers such as vinyl methyl ether or vinyl isobutyl ether; vinyl ketones such as vinyl methyl ketone, vinyl ethyl ketone, or vinyl isopropenyl ketone; a homopolymer of an olefin monomer such as ethylene, propylene, or butadiene, a copolymer obtained by combining two or more types of these monomers, or a mixture thereof, a non-vinyl condensation resin such as an epoxy resin, a polyester resin, a polyurethane resin, a polyamide resin, a cellulose resin, and a polyether resin, a mixture of the vinyl resin with these, or a graft polymer obtained by polymerizing a vinyl monomer under coexistence thereof is included. The resins may be used alone or in combination of two or more kinds thereof.

The content of the binder resin is, for example, in the range of from 80% by weight to 95% by weight with respect to the entirety of the toner particles.

The toner particles according to the exemplary embodiment may contain other additives such as a colorant, a release agent, a charge controlling agent, silica powder, and metal oxides if necessary. These additives may be internally added by kneading a binder resin or externally added by applying a mixing treatment after toner particles are obtained as particles.

The colorant is not particularly limited, and a well-known pigment is used, and a well-known dye may be added, if necessary. Specifically, respective dyes such as yellow, magenta, cyan, and black are used.

As the yellow pigment, a compound represented by a condensed azo compound, an isoindolinone compound, an anthraquinone compound, an azo metal complex compound, a methane compound, an allyl amide compound, and the like are used.

As the magenta pigment, a condensed azo compound, a diketopyrrolopyrrole compound, anthraquinone, a quinacridone compound, a basic dye lake compound, a naphthol compound, a benzimidazolone compound, a thioindigo compound, a perylene compound, and the like are used.

As the cyan pigment, a copper phthalocyanine compound and a derivative thereof, an anthraquinone compound, a basic dye lake compound, and the like are used.

As the black pigment, carbon black, aniline black, acetylene black, iron black, and the like are used.

The content of the colorant is, for example, in the range of from 5% by weight to 20% by weight with respect to all toner particles.

The release agent is not particularly limited, and, for example, vegetable wax such as carnauba wax, Japan wax, and rice bran wax; animal wax such as beeswax, insect wax, whale wax, and wool wax; mineral wax such as montan wax and ozokerite, Fischer Tropsch Wax (FT wax) having aster in a side chain, synthesized fatty acid solid ester wax such as special fatty acid ester and polyvalent alcohol ester; and synthetic wax such as paraffin wax, polyethylene wax, polypropylene wax, polytetrafluoroethylene wax, polyamide wax, and a silicone compound; and the like are included. The release agents may be used singly, or two or more types thereof may be used in combination.

The content of the release agent is, for example, in the range of from 0.1% by weight to 10% by weight with respect to all toner particles.

The charge controlling agent is not particularly limited, and a well-known charge controlling agent in the related art is used. For example, a positive charge controlling agent such as a nigrosine dye, a fatty acid-modified nigrosine dye, a carboxyl group containing fatty acid-modified nigrosine dye, quaternary ammonium salt, an amine compound, an amide compound, an imide compound, and an organic metal compound; and a negative charge controlling agent such as a metal complex of oxycarboxylic acid, a metal complex of azo compound, a metal complex salt dye, and a salicylic acid derivative; are included. The charge controlling agent may be used singly, or two or more types thereof may be used in combination.

The metal oxide is not particularly limited, and, for example, titanium oxide, aluminum oxide, magnesium oxide, zinc oxide, strontium titaniate, barium titaniate, magnesium titaniate, and calcium titaniate are included. The metal oxides may be used singly, or two or more types thereof may be used in combination.

Method of Preparing Toner Particles

As the method of preparing toner particles used in the exemplary embodiment, which is not particularly limited, for example, toner particles are obtained by milling a toner prepared using a method of preparing a milled toner, an in-liquid emulsified drying toner, or a polymerized toner in a carrier liquid. Next, the toner particles are immersion-treated by a solution containing an aluminum compound, filtered, and washed if necessary and the content of aluminum in toner particles measured by fluorescent X-ray analysis may be adjusted to be in the range of from 0.04% by weight to 0.1% by weight of total elements.

For example, a binder resin, if necessary, a colorant, and other additives are input and mixed in a HENSCHEL mixer, are melted and kneaded with a twin screw extruder, a BANBUY mixer, a roll mill, a kneader, and the like, are cooled with a drum flaker, are coarsely grinded with a grinder such as a hammer mill, are further pulverized with a grinder such as a jet mill, and are classified with an air classifier or the like so that a pulverized toner is obtained.

In addition, an in-liquid emulsification dry toner may be obtained by filtering and drying particles obtained by dissolving the binder resin, and if necessary, the colorant, and other additives in a solvent such as ethyl acetate, emulsifying and suspending the resultant in water in which a dispersion stabilizer such as calcium carbonate is added, removing the solvent, and then removing a dispersion stabilizing agent.

In addition, the polymerized toner may be obtained by adding and granulating a composition containing a polymerizable monomer that forms the binder resin, a colorant, a polymerization initiating agent (for example, benzoyl peroxide, lauryl peroxide, isopropyl peroxycarbonate, cumene hydroperoxide, 2,4-dichlorobenzoyl peroxide, and methyl ethyl ketone peroxide), other additives, and the like in water while stirring, performing polymerization, filtering particles, and drying the particles.

In addition, the combination ratio of respective materials (binder resin, colorant, other additives, and the like) at the time of obtaining the toner may be set depending on required characteristics, low temperature fixing properties, colors, and the like. The toner particles for a liquid developer according to the embodiment may be obtained by pulverizing the obtained toner in carrier oil by using a well-known grinding apparatus such as a ball mill, a bead mill, and a high-pressure wet atomizing apparatus.

The immersion treatment using a solution containing an aluminum compound is performed by adding the obtained toner particles to a solution such as an aqueous solution containing an aluminum compound and stirring the solution in a temperature range of from 10° C. to 80° C. for 10 minutes to 1 hour. After the immersion treatment is carried out, the resultant may be filtered and washed with water if necessary.

Examples of the aluminum compound used in the immersion treatment include aluminum salts such as aluminum sulfate and aluminum chloride, and a hydrate thereof.

In order for the content of aluminum in toner particles measured by fluorescent X-ray analysis to be in the range of from 0.04% by weight to 0.1% by weight of total elements, for example, the concentration of the aluminum compound to be used in a solution may be adjusted, the amount of a solution of the aluminum compound to be used may be adjusted, or the number of washing with water may be adjusted.

In the exemplary embodiment, in a case where the surface of the toner particles is treated using polyamines, the surface treatment may be performed after the toner particles are immersion-treated by a solution containing an aluminum compound. In a case where the surface of the toner particles is treated using polyamines, in terms of ease of the surface treatment using polyamines, it is preferable that the toner particles are toner particles obtained by aggregating a dispersion containing resin particles having a binder resin in an aqueous medium. Since polyamines are water-soluble polymers, polyamines may be adsorbed by the surface of toner particles after washing with water and before a drying process according to the wet method of granulating toner particles in a liquid.

Characteristics of Toner Particles

A volume average particle diameter D50v of the toner particles is preferably in the range of from 0.5 μm to 5.0 μm. When the volume average particle diameter D50v is in the above-described range, adhesion force is increased and developing properties are improved. Further, the resolution of an image is improved. The volume average particle diameter D50v of the toner particles is more preferably in the range of from 0.8 μm to 4.0 μm and still more preferably in the range of from 1.0 μm to 3.0 μm.

The volume average particle diameter D50v, the number average particle size distribution index (GSDp), and the volume average particle size distribution index (GSDv) of the toner particles are measured using a laser diffraction/scattering particle size distribution measuring device, for example, LA920 (manufactured by Horiba, Ltd.). Cumulative distributions of the volume and the number are drawn from the small diameter side with respect to the particle size range (channel) divided based on the measured particle size distribution, and the particle diameter corresponding to 16% cumulation is defined as a volume particle diameter D16v and a number particle diameter D16p, the particle diameter corresponding to 50% cumulation is defined as a volume particle diameter D50v and a number particle diameter D50p, and the particle diameter corresponding to 84% cumulation is defined as a volume particle diameter D84v and a number particle diameter D84p. Using these definitions, the volume average particle size distribution index (GSDv) is calculated as $(D84v/D16v)^{1/2}$ and the number average particle size distribution index (GSDp) is calculated as $(D84p/D16p)^{1/2}$.

Carrier Liquid

The carrier liquid is an insulating liquid for dispersing toner particles and examples thereof include silicone oil whose polymerization degree of dimethyl silicone, diphenyl silicone, or hydrogen-modified silicone compound is greater than 20 and silicone oil such as a cyclic siloxane compound (silicone solvent). Among these, in terms of the viscosity and dispersibility, dimethyl silicone is preferable. Further, "using silicone oil as a main component" means that 50% by weight or greater of silicone oil is contained in a carrier liquid.

The carrier liquid contained in the liquid developer of the exemplary embodiment may be used alone or in combination of two or more kinds thereof. In the case where the carrier liquid is used as a mixture of two or more kinds thereof, a mixture of a silicone solvent and vegetable oil is exemplified.

For example, the volume resistivity of the carrier liquid is in the range of from $1.0\times10^{10}$ Ω·cm to $1.0\times10^{14}$ Ω·cm and may be in the range of from $1.0\times10^{12}$ Ω·cm to $1.0\times10^{14}$ Ω·cm.

The viscosity of the carrier liquid is preferably in the range of from 1 mPa·s to 100 mPa·s, more preferably in the range of from 1 mPa·s to 80 mPa·s, and still more preferably in the range of from 1 mPa·s to 60 mPa·s in terms of stead shear viscosity at 25° C. The steady shear viscosity is less than 1 mPa·s, the molecular weight of silicone oil or the like may be decreased. In addition, when the steady shear viscosity is greater than 100 mPa·s, since the viscosity of the developer using the carrier oil is increased, desired characteristics may not be obtained.

The carrier liquid may contain various types of auxiliary materials, for example, a dispersion agent, an emulsifying agent, surfactant, a stabilizing agent, a wetting agent, a thickening agent, a foaming agent, an antifoaming agent, coagulant, a gelling agent, an anti-settling agent, a charge controlling agent, an antistatic agent, an antioxidant, a softening agent, a plasticizer, a filler, a flavoring agent, an adhesion-preventing agent, and a release agent.

It is preferable that the liquid developer according to the exemplary embodiment contains a carboxyl group-containing silicone compound. In the liquid developer obtained by dispersing toner particles containing a binder resin in a carrier liquid, a liquid developer having more excellent positive charging characteristics is obtained when toner particles whose surface is treated by polyamines are used as toner particles and a carboxyl group-containing silicone compound is contained.

As the carboxylic group-containing silicone compound, a compound represented by the following formula (II) is exemplified. The compound represented by the following formula (II) is highly cationic and tends to be positively charged.

(II)

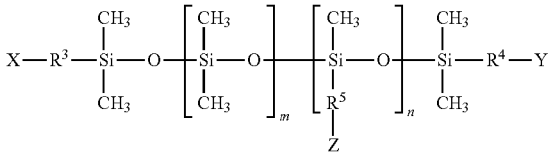

(In the formula (II), X, Y, and Z each independently represent a hydrogen atom or a carboxyl group and at least one of X, Y, and Z represents a carboxyl group. m represents an integer of 1 to 1,000 and n represents an integer of 1 to 10. $R^3$, $R^4$, and $R^5$ each independently represent a single bond or a divalent aliphatic hydrocarbon group having 1 to 20 carbon atoms.)

In the formula (II), one of X, Y, and Z may represent a carboxyl group, two of X, Y, and Z may represent a carboxyl group, and all of X, Y, and Z may represent a carboxyl group.

In the formula (II), $R^3$, $R^4$, and $R^5$ each independently represent a single bond or a divalent aliphatic hydrocarbon group having 1 to 20 carbon atoms and preferably represent a single bond or a divalent aliphatic hydrocarbon group having 3 to 12 carbon atoms. Examples of the divalent aliphatic hydrocarbon group having 1 to 20 carbon atoms include a methylene group, an ethylene group, a trimethylene group, a tetramethylene group, a hexamethylene group, an octamethylene group, a decamethylene group, an undecamethylene group, a dodecamethylene group, a hexadecamethylene group, and an octadecamethylene group. Among these, a trimethylene group, a tetramethylene group, a hexamethylene group, an octamethylene group, a decamethylene group, an undecamethylene group, and a dodecamethylene group are preferable.

In the formula (II), m represents an integer of 1 to 1,000 and preferably represents an integer of 5 to 100. In the formula (II), n represents an integer of 1 to 10 and preferably represents an integer of 1 to 5.

The amount of the carboxyl group-containing silicone compound in the liquid developer is preferably in the range of from 0.001 parts by weight to 10 parts by weight and more preferably in the range of from 0.01 parts by weight to 1 part by weight with respect to 100 parts by weight of the liquid developer. When the amount of the carboxyl group-containing silicone compound with respect to the liquid developer is less than 0.001 parts by weight with respect to 100 parts by weight of the liquid developer, charging properties may deteriorated. Meanwhile, when the amount thereof exceeds 10 parts by weight, conductivity is excessively increased and thus the charging properties may be deteriorated.

The weight average molecular weight of the carboxyl group-containing silicone compound is preferably in the range of from 100 to 100,000 and more preferably in the range of from 1,000 to 10,000. When the weight average molecular weight of the carboxyl group-containing silicone compound is less than 100, the compatibility with the liquid developer may not be sufficient. Meanwhile, when the weight average molecular weight thereof exceeds 100,000, fixing properties of the developer may be degraded.

It is preferable that the liquid developer according to the exemplary embodiment contains an olefin/maleic acid derivative copolymer having a polysiloxane structure in the main chain or side chain thereof. In the liquid developer obtained by dispersing toner particles containing a binder resin in a carrier liquid, a liquid developer having more excellent positive charging characteristics is obtained when toner particles whose surface is treated by polyamines are used as toner particles and an olefin/maleic acid derivative copolymer having a polysiloxane structure in the main chain or side chain thereof is contained.

The reason for excellent positive charging properties is considered that an olefin/maleic acid derivative copolymer having a polysiloxane structure in the main chain or side chain thereof forms counter anions while highly cationic polyamines are strongly adhered to the surface of toner particles in the liquid developer.

As the olefin/maleic acid derivative copolymer having a polysiloxane structure in the main chain or side chain thereof, a compound represented by the following formula (III) is exemplified.

(III)

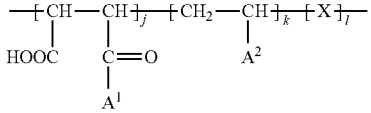

(In the formula (III), $A^1$ represents $NR^1R^2$ or $OR^1$; $R^1$ and $R^2$ each independently represent a hydrogen atom or an aliphatic or aromatic hydrocarbon group which may be substituted and has 1 to 20 carbon atoms; $A^2$ represents $R^3$ or $OR^3$; $R^3$ represents an aliphatic or aromatic hydrocarbon group which may be substituted and has 1 to 20 carbon atoms; X represents a divalent organic group having a polysiloxane structure in the main chain or side chain thereof; j and k each independently represent an integer of 1 to 1,000; and l represents an integer of 1 to 100.)

As the compound represented by the formula (III) above, a compound represented by the following formula (IV), a compound represented by the following formula (V), or a compound represented by the following formula (VI) is exemplified.

(IV)

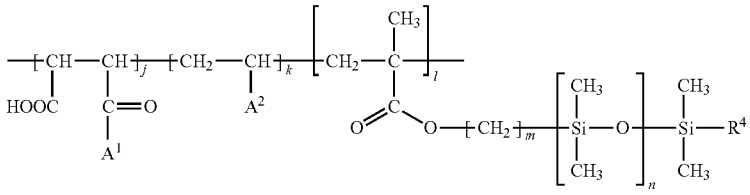

(In the formula (IV), $A^1$ represents $NR^1R^2$ or $OR^1$; $R^1$ and $R^2$ each independently represent a hydrogen atom or an aliphatic or aromatic hydrocarbon group which may be substituted and has 1 to 20 carbon atoms; $A^2$ represents $R^3$ or $OR^3$; $R^3$ represents an aliphatic or aromatic hydrocarbon group which may be substituted and has 1 to 20 carbon atoms; $R^4$ represents an aliphatic hydrocarbon group having 1 to 20 carbon atoms; j and k each independently represent an integer of 1 to 1,000; l represents an integer of 1 to 100; m represents an integer of 1 to 20; and n represents an integer of 1 to 1,000.)

(V)

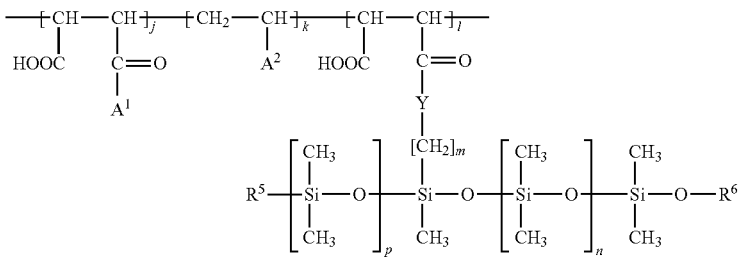

(In the formula (V), $A^1$ represents $NR^1R^2$ or $OR^1$; $R^1$ and $R^2$ each independently represent a hydrogen atom or an aliphatic or aromatic hydrocarbon group which may be substituted and has 1 to 20 carbon atoms; $A^2$ represents $R^3$ or $OR^3$; $R^3$ represents an aliphatic or aromatic hydrocarbon group which may be substituted and has 1 to 20 carbon atoms; Y represents an oxygen atom or NH; $R^4$ and $R^5$ each independently represent an aliphatic hydrocarbon group having 1 to 20 carbon atoms; j and k each independently represent an integer of 1 to 1,000; l represents an integer of 1 to 100; m represents an integer of 1 to 20; n represents an integer of 1 to 1,000; and p represents an integer of 0 to 1,000.)

(VI)

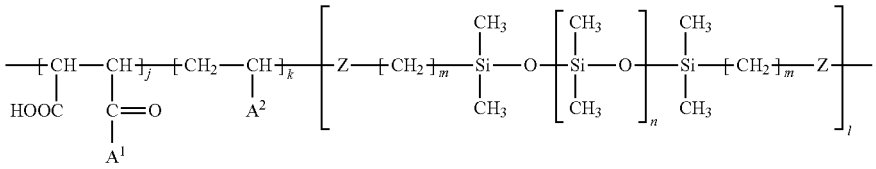

(In the formula (VI), $A^1$ represents $NR^1R^2$ or $OR^1$; $R^1$ and $R^2$ each independently represent a hydrogen atom or an aliphatic or aromatic hydrocarbon group which may be substituted and has 1 to 20 carbon atoms; $A^2$ represents $R^3$ or $OR^3$; $R^3$ represents an aliphatic or aromatic hydrocarbon group which may be substituted and has 1 to 20 carbon atoms; Z represents a divalent organic group; j and k each independently represent an integer of 1 to 1,000; l represents an integer of 1 to 100; m represents an integer of 1 to 20; and n represents an integer of 1 to 1,000.)

In the formulae (III) to (VI), $R^1$ and $R^2$ each independently represent a hydrogen atom or an aliphatic or aromatic hydrocarbon group which may be substituted and has 1 to 20 carbon atoms and a hydrogen atom or an aliphatic or aromatic hydrocarbon group which may be substituted and has 3 to 20 carbon atoms is preferable in terms of solubility and manufacturability. $R^3$ represents an aliphatic or aromatic hydrocarbon group which may be substituted and has 1 to 20 carbon atoms and an aliphatic or aromatic hydrocarbon group which may be substituted and has 4 to 18 carbon atoms is preferable in terms of solubility and manufacturability. $R^4$ and $R^5$ each independently represent an aliphatic hydrocarbon group having 1 to 20 carbon atoms and an aliphatic hydrocarbon group having 1 to 10 carbon atoms is preferable in terms of manufacturability.

Examples of the aliphatic hydrocarbon group having 1 to 20 carbon atoms include a methyl group, an ethyl group, a linear or branched propyl group, a butyl group, a pentyl group, a hexyl group, an octyl group, a decyl group, a dodecyl group, a tridecyl group, a hexadecyl group, and an octadecyl group. Among these, in terms of solubility, a propyl group, a butyl group, a pentyl group, a hexyl group, an octyl group, a decyl group, a dodecyl group, a tridecyl group, a hexadecyl group, or an octadecyl group is preferable.

Examples of the aromatic hydrocarbon group having 1 to 20 carbon atoms include a phenyl group, a naphthyl group, an anthryl group, a phenanthryl group, a biphenylyl group. Among these, a phenyl group or a naphthyl group is preferable in terms of manufacturability and stability.

Examples of the substituent which may be substituted with an aliphatic or aromatic hydrocarbon group having 1 to 20 carbon atoms include a halogen atom, a hydroxy group, an amino group, an alkyl group having 1 to 10 carbon atoms, an alkoxy group, an alkylamino group, and a dialkylamino group. Among these, in terms of solubility and charge controlling characteristics, an alkyl group having 1 to 10 carbon atoms or a dialkylamino group is preferable.

Examples of the divalent organic group represented by the formula (VI) include $—CH(CH_3)—(CH_2)_2C(=O)NH—$, $—C(CH_3)(CN)—(CH_2)_2C(=O)NH—$, and $—C(CH_3)(CN)—(CH_2)_3C(=O)NH—$. In terms of manufacturability, $—C(CH_3)(CN)—(CH_2)_2C(=O)NH—$ is preferable.

In the formula (III), j and k each independently represent an integer of 1 to 1,000, and an integer of 5 to 100 is preferable in terms of solubility and charge controlling characteristics.

In the formulae (III) to (VI), l represents an integer of 1 to 100, and an integer of 1 to 10 is preferable in terms of solubility and charge controlling characteristics.

In the formulae (IV) to (VI), m represents an integer of 1 to 20, and an integer of 3 to 10 is preferable in terms of manufacturability. n represents an integer of 1 to 1,000.

In the formula (V), p represents an integer of 0 to 1,000, and an integer of 10 to 300 is preferable in terms of solubility and manufacturability.

The amount of the olefin/maleic acid derivative copolymer having a polysiloxane structure in the main chain or side chain thereof in the liquid developer is preferably in the range of from 0.01 parts by weight to 1 part by weight and more preferably in the range of from 0.1 parts by weight to 0.5 parts by weight with respect to 100 parts by weight of the liquid developer. When the amount of the olefin/maleic acid derivative copolymer having a polysiloxane structure in the main chain or side chain thereof in the liquid developer is less than 0.01 parts by weight with respect to 100 parts by weight of the liquid developer, the charging properties may be deteriorated. When the amount thereof exceeds 1 part by weight, the conductivity becomes extremely high and this may lead to deterioration of the charging properties.

The weight average molecular weight of the olefin/maleic acid derivative copolymer having a polysiloxane structure in the main chain or side chain thereof is preferably in the range of from 1,000 to 100,000 and more preferably in the range of from 5,000 to 20,000. When the weight average molecular weight of the olefin/maleic acid derivative copolymer having a polysiloxane structure in the main chain or side chain thereof is less than 1,000, the compatibility with the liquid developer may not be sufficient. When the weight average molecular weight thereof exceeds 100,000, the fixing properties of the developer may be degraded.

Method of Preparing Liquid Developer

The liquid developer according to the exemplary embodiment is obtained by mixing the above-described toner particles and the carrier liquid using a disperser such as a ball mill, a sand mill, an attritor, or a bead mill, milling the mixture, and dispersing the toner particles in the carrier liquid. In addition, the dispersion of the toner particles in the carrier liquid is not limited to the disperser, and the dispersion may be performed by rotating special stirring blades such as a mixer at a high speed, by shearing force of a rotor and stator known as a homogenizer, or by ultrasonic waves.

From a viewpoint of appropriately controlling a viscosity of the developer and smoothly circulating the developing liquid in a developing machine, the concentration of the toner particles in the carrier liquid is preferable in the range of from 0.5% by weight to 40% by weight, and more preferably in the range of from 1% by weight to 30% by weight.

Thereafter, the obtained dispersion is filtered with a filter such as a membrane filter with a pore diameter of approximately 100 μm to remove waste and coarse particles.

Developer Cartridge, Process Cartridge, and Image Forming Apparatus

An image forming apparatus according to the exemplary embodiment includes an image holding member (hereinafter, also referred to as a "photoreceptor"); a charging unit that charges the surface of the image holding member; a latent image forming unit that forms a latent image (electrostatic latent image) on the surface of the image holding member; a developing unit that develops the latent image formed on the surface of the image holding member using the liquid developer according to the exemplary embodiment, which is held on the surface of a developer holding member, to form a toner image; a transfer unit that transfers the toner image formed on the surface of the image holding member onto a recording medium; and a fixing unit that fixes the toner image transferred onto the recording medium to the recording medium to form a fixed image.

Further, an image forming method according to the exemplary embodiment includes a latent image forming process of forming a latent image on the surface of an image holding member; a developing process of developing the latent image formed on the surface of the image holding member using the liquid developer according to the exemplary embodiment which is held on the surface of the developer holding member; a transfer process of transferring the toner image formed on the surface of the image holding member onto a recording medium; and a fixing process of fixing the toner image transferred onto the recording medium to the recording medium to form a fixed image.

The image forming apparatus may have, for example, a cartridge structure (process cartridge) in which a portion including a developing unit is detachable from a main member of the image forming apparatus. The process cartridge is not particularly limited as long as the process cartridge accommodates the liquid developer according to the exemplary embodiment. The process cartridge accommodates the liquid developer according to the exemplary embodiment, includes a developing unit that develops the latent image formed on the image holding member with the liquid developer and forms the toner image, and is detachable from the image forming apparatus.

In addition, the developer cartridge according to the embodiment is not particularly limited as long as the developer cartridge accommodates the liquid developer according to the exemplary embodiment. The developer cartridge accommodates the liquid developer according to the exemplary embodiment, and is detachable from the image forming apparatus including the developing unit that forms the toner image by developing the latent image formed on the image holding member with the liquid developer. The developer cartridge may have a container which stores the liquid developer.

Hereinafter, an example of an image forming apparatus using the liquid developer according to the exemplary embodiment will be described with reference to the accompanying FIGURE.

FIG. 1 is a configuration view schematically illustrating an example of the image forming apparatus according to the exemplary embodiment. An image forming apparatus 100 includes a photoreceptor (image holding member) 10; a charging device (charging unit) 20; an exposure device (latent image forming unit) 12; a developing device (developing unit) 14; an intermediate transfer member (transfer unit) 16; a cleaner (cleaning unit) 18; and a transfer fixation roller (transfer unit, fixing unit) 28. The photoreceptor 10 is cylindrical and the charging device 20, the exposure device 12, the developing device 14, the intermediate transfer member 16, and the cleaner 18 are sequentially provided on the outer periphery of the photoreceptor 10.

Hereinafter, operations of the image forming apparatus 100 are described.

The charging device 20 charges the surface of the photoreceptor 10 to a predetermined potential (charging process), and the exposure device 12 forms a latent image (electrostatic latent image) by exposing the charged surface with laser beams based on an image signal (latent image forming process).

The developing device 14 includes a developing roller 14*a* and a developer accommodating container 14*b*. The developing roller 14*a* is installed so that a portion thereof is immersed in a liquid developer 24 accommodated in the developer accommodating container 14*b*. The liquid developer 24 includes an insulating carrier liquid, toner particles containing a binder resin, and the charge controlling agent.

Though the toner particles are dispersed in the liquid developer 24, for example, the positional variation of concentrations of the toner particles in the liquid developer 24 is decreased, by continuously stirring the liquid developer 24 with a stirring member provided in the developer accommodating container 14*b*. Accordingly, the liquid developer 24 in which the positional variation of the concentrations of the toner particles is decreased is supplied to the developing roller 14*a* that rotates in an arrow A direction in FIG. 1.

The liquid developer 24 supplied to the developing roller 14*a* is transferred to the photoreceptor 10 in a state of being regulated to a certain supply amount by a regulation member, and is supplied to the electrostatic latent image in a position in which the developing roller 14*a* and the photoreceptor 10 are close to each other (or contact with each other). Accordingly, the electrostatic latent image is developed to become a toner image 26 (developing process).

The developed toner image 26 is transported to the photoreceptor 10 that rotates in an arrow B direction in FIG. 1, and is transferred to paper (recording medium) 30. However, according to the exemplary embodiment, before the toner image is transferred to the paper 30, in order to enhance the transfer efficiency to the recording medium together with the separation efficiency of the toner image from the photoreceptor 10 and to cause the toner image to be fixed at the same time as being transferred to the recording medium, the toner image is once transferred to the intermediate transfer member 16 (intermediate transfer process). At this point, the circumferential speed between the photoreceptor 10 and the intermediate transfer member 16 may be provided.

Subsequently, the toner image transported in an arrow C direction by the intermediate transfer member 16 is fixed at the same time as being transferred to the paper 30 in a contact position with the transfer fixation roller 28 (transfer process and fixing process). The paper 30 is interposed between the transfer fixation roller 28 and the intermediate transfer member 16, and the toner image on the intermediate transfer member 16 is in contact with the paper 30. Accordingly, the toner image is transferred to the paper 30, and the toner image is fixed on the paper, to be a fixed image 29. It is preferable that the toner image is fixed by providing a heating member on the transfer fixation roller 28 and pressurizing and heating the toner image. The fixation temperature is, generally, in the range of from 120° C. to 200° C.

If the intermediate transfer member 16 has a roller shape as illustrated in FIG. 1, the intermediate transfer member 16 and the transfer fixation roller 28 configure a roller pair. Therefore, the intermediate transfer member 16 and the transfer fixation roller 28 respectively correspond to a fixation roller and a pressurization roller in a fixing device, and exhibit a fixing function. That is, if the paper 30 passes through a nip formed between the intermediate transfer member 16 and the transfer fixation roller 28, the toner image is transferred and also is heated and pressurized with respect to the intermediate transfer member 16 by the transfer fixation roller 28. Accordingly, the toner image permeates into fibers of the paper 30 while the binder resins in the toner particles that configure the toner image are softened, so that the fixed image 29 is formed on the paper 30.

According to the exemplary embodiment, the image is transferred to and fixed on the paper 30 at the same time, but the transfer process and the fixation process may be respectively performed so that the image is fixed after being transferred. In this case, the transfer roller that transfers the toner image from the photoreceptor 10 has a function corresponding to the intermediate transfer member 16.

Meanwhile, in the photoreceptor 10 that transfers the toner image 26 to the intermediate transfer member 16, remaining toner particles that are not transferred are moved to a contact position with the cleaner 18, and collected by the cleaner 18. In addition, if the transfer efficiency is near 100%, and the remaining toner does not cause problems, the cleaner 18 may not be provided.

The image forming apparatus 100 may further include an erasing device (not illustrated) that erases the surface of the photoreceptor 10 after transfer or next charging.

All of the charging device 20, the exposure device 12, the developing device 14, the intermediate transfer member 16, the transfer fixation roller 28, and the cleaner 18 which are included in the image forming apparatus 100 may be operated in synchronization with the rotation speed of the photoreceptor 10.

EXAMPLES

Hereinafter, the invention is more specifically described with reference to Examples and Comparative Examples, but the invention is not limited thereto.

Example 1

Preparation of Toner Particles (Cyan)

40 parts by weight of a cyan pigment (C. I. Pigment Blue 15:3, manufactured by Clariant, Ltd.) is added to 60 parts by weight of a polyester resin (manufactured by Kao Corporation, weight average molecular weight: 15,000), and the mixture is kneaded by a pressure kneader. The kneaded material is coarsely milled and thus a cyan pigment masterbatch is prepared.

Next, a mixture having the following composition is dissolved and dispersed in a ball mill for 24 hours.

Polyester resin (manufactured by Kao Corporation, weight average molecular weight: 15,000): 70 parts by weight The cyan pigment masterbatch: 25 parts by weight Ethyl acetate: 100 parts by weight 50 parts by weight of calcium carbonate (manufactured by Maruo Calcium Co., Ltd., LUMINOUS), as a dispersion stabilizer, is added to an aqueous solution obtained by dissolving 60 parts by weight of sodium chloride (manufactured by Wako Pure Chemical Industries, Ltd.) in 400 parts by weight of ion exchange water, and the solution is dispersed using a ball mill for 24 hours to prepare a dispersion medium. 100 parts by weight of the mixture is put into 170 parts by weight of the dispersion medium and emulsified using a homogenizer (manufactured by IKA, Inc., ULTRA-TURRAX T-50) at 8,000 rpm to 24,000 rpm for 1 minute, thereby obtaining a suspension. The suspension is put into a separable flask provided with a stirrer, a thermometer, a cooling tube, and a nitrogen inlet tube, stirring is performed at 60° C. for 3 hours while nitrogen flows in from the nitrogen inlet tube, and ethyl acetate is distilled. After allowed to stand for cooling, calcium carbonate is decomposed by adding a 10% hydrochloric acid aqueous solution to the mixture, and the solid content is separated therefrom by centrifugation. The resultant is washed three times using 1 L of ion exchange water, thereby obtaining a wet cake of toner particles having a volume average particle diameter of 3.5 μm.

The obtained wet cake of coarse toner particles is re-dispersed in 400 parts by weight of distilled water, the pH thereof is adjusted to 4 by adding 1 N of hydrochloric acid, 20 parts by weight of an aqueous solution obtained by dissolving 1 part by weight of 14 to 18 hydrates of aluminum sulfate in 10 parts by weight of distilled water is added thereto, the mixture is continuously stirred for 1 hour at room temperature (20° C. to 25° C.), the mixture is filtered, and then the filtered particles are washed with 1,000 parts by weight of water 5 times.

100 parts by weight of the wet cake of washed toner particles is re-dispersed in 400 parts by weight of distilled water, the pH thereof is adjusted to 2 by adding 5 parts by weight of 1 N hydrochloric acid, 20 parts by weight of a 5 wt % aqueous solution of polyethyleneimine (manufactured by JUNSEI CHEMICAL CO., LTD., weight average molecular weight: 70,000) is slowly added dropwise while the mixture is stirred, and the stirring is continued for 1 hour after the addition is finished. After the stirring is finished, the dispersion is suctioned and filtered, and the filtered particles are continuously washed with water. The obtained cake is freeze-dried at 25° C. for 48 hours to thereby collect 90 parts by weight of dry cyan toner particles.

Measurement of Content of Aluminum

A disk with a toner amount of 0.130 g is formed using the dry cyan toner particles obtained in the above-described manner and the content (% by weight in total elements) of aluminum in the toner particles is measured with a scanning fluorescent X-ray analyzer (ZSX PRIMUS II, manufactured by Rigaku Corporation) according to a qualitative and quantitative total elements analysis method under the conditions of an X-ray output of 40 mA to 70 mA, a measurement area of 10 mmϕ, and a measuring time of 15 minutes. In addition, "lower than or equal to the detection limit" means 0.001% by weight or less of total elements.

Preparation of Liquid Developer 30 parts by weight of the obtained cyan toner particles are mixed with 70 parts by weight of silicone oil (KF-96-20cs, manufactured by Shin-Etsu Chemical Co., Ltd.) to thereby obtain a liquid developer having a solid content concentration of 30% by weight.

Evaluation

Positive Charging Characteristic

An aluminum substrate (15 cm×25 cm) is coated with the liquid developer obtained in the above-described manner using a wire bar (winding wire, 1 mm), to thereby form a dispersion film having a width of 12 cm, a length of 15 cm and a film thickness of 7 μm to 8 μm. The sample is irradiated with corona at a scanning speed of 40 m/min using a corotron adjusted to have a current value of 40 μA and the potential on the surface of the dispersion film after 1 second from the irradiation using a surface electrometer is measured. The results are shown in Table 1.

Image Quality

The charge maintaining properties are evaluated by setting the liquid developer obtained in the above-described manner in an image forming apparatus (manufactured by Fuji Xerox Co., Ltd., model number: 2,000) modified to a liquid developing system, and a 100-th image is visually observed after images are continuously formed using a test chart (No. 3) designated by ISO Japan Business Machine and Information System Industries Association. The evaluation is performed according to the following criteria. The results are shown in Table 1.

A: Image defects are not observed at all.

B: Image defects are partially observed.

C: Image defects are remarkably observed.

Charging Polarity

Two sheets of ITO glass substrates (100 Ω/square, manufactured by EHC Inc.) processed to have a dimension of 5 cm×1 cm are fixed so that a NAFLON sheet (1 cm×1 cm×1.0 mm, manufactured by AS ONE Corporation) as an insulating spacer is interposed between the substrates such that the electrode surfaces of the substrates become inward. 1 mL of a liquid developer sample is put in a disposable cell (12 mm×12 mm×45 mm, manufactured by AS ONE Corporation), the above-described electrode substrates are immersed, 250 V of a DC voltage is applied thereto for 30 seconds, the electrodes are pulled up in a state in which the voltage is applied, the state of particles being adhered to the positive and negative ITO electrode surfaces is observed, and the charging characteristics are determined. The results thereof are shown in Table 1. In addition, when the charging characteristics below show positive and negative (±), this means that particles having positive polarity and particles having negative polarity are evenly mixed with each other, but fog occurs in a bright image portion in an actual system of a developer exhibiting such characteristics. Therefore, such developer is not suitable for both of a positively charged system and a negatively charged system.

+: The particles are only adhered to a negative electrode.

−: The particles are only adhered to a positive electrode.

±: The particles are adhered to both electrodes.

X: The particles are not adhered to either electrodes.

In addition, the toner particles may be collected from the liquid developer by the following method. The liquid developer is precipitated by centrifugation (1,000 rpm×5 minutes), the supernatant liquid is removed by decantation, and the toner particles are taken out. The taken-out toner particles are washed with hexane or ISOPER (the mixed solvent may be appropriately changed depending on a type of the toner resin).

Example 2

The wet cake of coarse toner particles obtained in Example 1 is re-dispersed in 400 parts by weight of distilled water, the pH thereof is adjusted to 4 by adding 1 N of hydrochloric acid, 20 parts by weight of an aqueous solution obtained by dissolving 1 part by weight of aluminum chloride hexahydrate into 10 parts by weight of distilled water is added thereto, the mixture is continuously stirred for 1 hour at room temperature (20° C. to 25° C.), the mixture is filtered, and then the filtered particles are washed with 1,000 parts by weight of water 5 times.

The wet cake of washed toner particles is re-dispersed in 400 parts by weight of distilled water, the pH thereof is adjusted to 2 by adding 5 parts by weight of 1 N of hydrochloric acid, 20 parts by weight of a 5 wt % aqueous solution of polyethyleneimine (manufactured by JUNSEI CHEMICAL CO., LTD., weight average molecular weight: 70,000) is slowly added dropwise while the mixture is stirred, and the stirring is continued for 1 hour after the addition is finished. After the stirring is finished, the dispersion is suctioned and filtered, and the filtered particles are continuously washed with water. The obtained cake is freeze-dried at 25° C. for 48 hours to thereby collect 90 parts by weight of dry cyan toner particles.

The content of aluminum is measured, the liquid developer is prepared, and the evaluations are performed in the same manner as in Example 1 using the dry cyan toner particles obtained in the above-described manner. The results are shown in Table 1.

Example 3

Preparation of Toner Particles (Magenta)

40 parts by weight of a magenta pigment (C. I. Pigment Red 122, manufactured by Clariant, Ltd.) is added to 60 parts by weight of a polyester resin (manufactured by Kao Corporation, weight average molecular weight: 15,000), and the mixture is kneaded by a pressure kneader. The kneaded material is coarsely milled to thereby obtain a magenta pigment masterbatch.

Next, a mixture having the following composition is dissolved and dispersed in a ball mill for 24 hours.

Polyester resin (manufactured by Kao Corporation, weight average molecular weight: 15,000): 70 parts by weight The magenta pigment masterbatch: 25 parts by weight Ethyl acetate: 100 parts by weight 50 parts by weight of calcium carbonate (LUMINOUS, manufactured by Maruo Calcium Co., Ltd.) is added to, as a dispersion stabilizer, an aqueous solution obtained by dissolving 60 parts by weight of sodium chloride (manufactured by Wako Pure Chemical Industries, Ltd.) in 400 parts by weight of ion exchange water, and the solution is dispersed using a ball mill for 24 hours to prepare a dispersion medium. 100 parts by weight of the mixture is put into 170 parts by weight of the dispersion medium and emulsified using a homogenizer (ULTRA-TURRAX T-25, manufactured by IKA, Inc.) at 8,000 rpm to 24,000 rpm for 1 minute, thereby obtaining a suspension. The suspension is put into a separable flask provided with a stirrer, a thermometer, a cooling tube, and a nitrogen inlet tube, stirring is performed at 60° C. for 3 hours while nitrogen flows in from the nitrogen inlet tube, and ethyl acetate is distilled. After cooling, calcium carbonate is decomposed by adding a 10% hydrochloric acid aqueous solution to the mixture, and the solid content is separated therefrom by centrifugation. The resultant is washed three times using 1 L of ion exchange water, thereby obtaining a wet cake of toner particles having a volume average particle diameter of 3.2 μm.

The obtained wet cake of coarse toner particles is re-dispersed in 400 parts by weight of distilled water, the pH thereof is adjusted to 4 by adding 1 N of hydrochloric acid, 20 parts by weight of an aqueous solution obtained by dissolving 1 part by weight of 14 to 18 hydrates of aluminum sulfate in 10 parts by weight of distilled water, the mixture is continuously stirred for 1 hour at room temperature (20° C. to 25° C.), the mixture is filtered, and then the filtered mixture is washed with 1,000 parts by weight of water 5 times.

100 parts by weight of the wet cake of washed toner particles is re-dispersed in 400 parts by weight of distilled water, the pH thereof is adjusted to 2 by adding 5 parts by weight of 1N of hydrochloric acid, the mixture is stirred for 1 hour and then filtered, and the filtered particles are continuously washed with distilled water. The collected cake is re-dispersed by adding 300 parts by weight of distilled water thereto, 20 parts by weight of a 5 wt % aqueous solution of polyethyleneimine (manufactured by JUNSEI CHEMICAL CO., LTD., weight average molecular weight: 70,000) is slowly added dropwise while the mixture is stirred, and the stirring is continued for 1 hour after the addition is finished. After the stirring is finished, the dispersion is suctioned and filtered, and the filtered particles are continuously washed with water. The obtained cake is freeze-dried at 20° C. for 24 hours to thereby collect 85 parts by weight of dry magenta toner particles.

The content of aluminum is measured, the liquid developer is prepared, and the evaluations are performed in the same manner as in Example 1 using the dry magenta toner particles obtained in the above-described manner. The results are shown in Table 1.

Example 4

The wet cake of coarse toner particles obtained in Example 3 is re-dispersed in 400 parts by weight of distilled water, the pH thereof is adjusted to 4 by adding 1 N of hydrochloric acid, 50 parts by weight of an aqueous solution obtained by dissolving 1 part by weight of aluminum chloride hexahydrate in 10 parts by weight of distilled water, the mixture is continuously stirred for 1 hour at room temperature (20° C. to 25° C.), the mixture is filtered, and then the filtered mixture is washed with 1,000 parts by weight of water 5 times.

The wet cake of washed toner particles is re-dispersed in 400 parts by weight of distilled water, the pH thereof is adjusted to 2 by adding 5 parts by weight of 1 N of hydrochloric acid, 20 parts by weight of a 5 wt % aqueous solution of polyethyleneimine (manufactured by JUNSEI CHEMICAL CO., LTD., weight average molecular weight: 70,000) is slowly added dropwise while the mixture is stirred, and the stirring is continued for 1 hour after the addition is finished. After the stirring is finished, the dispersion is suctioned and filtered, and the filtered particles are continuously washed with water. The obtained cake is freeze-dried at 25° C. for 48 hours to thereby collect 85 parts by weight of dry magenta toner particles.

The content of aluminum is measured, the liquid developer is prepared, and the evaluations are performed in the same manner as in Example 1 using the dry magenta toner particles obtained in the above-described manner. The results are shown in Table 1.

Example 5

Synthesis of Polyester Resin

Synthesis of Amorphous Polyester Resin (1)

80 parts by mole of polyoxypropylene(2,2)-2,2-bis(4-hydroxyphenyl)propane, 20 parts by mole of polyoxyethylene (2,2)-2,2-bis(4-hydroxyphenyl)propane, 50 parts by mole of terephthalic acid, 25 parts by mole of fumaric acid, and 25 parts by mole of n-dodecenylsuccinic acid as raw materials and dibutyltin oxide as a catalyst are put into a heated and dried two-necked flask, nitrogen gas is introduced into the flask to be maintained in an inert environment, the temperature therein is increased, a co-polycondensation reaction is applied thereto in the temperature range of from 150° C. to 230° C. for approximately 12 hours, and the pressure is slowly reduced in the temperature range of from 210° C. to 250° C., and thus an amorphous polyester resin (1) is synthesized.

The weight average molecular weight (Mw) of the obtained amorphous polyester resin (1) is 17,900. Further, the acid value of the amorphous polyester resin (1) is 14.6 mgKOH/g. Further, the melting temperature of the amorphous polyester resin (1) is obtained through measurement using a differential scanning calorimeter (DSC) and analysis according to JIS standard (see JIS K-7121). As a result, a change in stepwise endothermic amount without showing a clear peak is observed. The glass transition temperature (Tg) determined by employing the intermediate point in the change of the stepwise endothermic amount is 60° C.

Synthesis of Amorphous Polyester Resin (2)

An amorphous polyester resin (2) is synthesized in the same manner as that of the amorphous polyester resin (1) except that 50 parts by mole of polyoxyethylene (2,0)-2,2-bis(4-hydroxyphenyl)propane, 40 parts by mole of polyoxypropylene (2,2)-2,2-bis(4-hydroxyphenyl)propane, 10 parts by mole of ethylene glycol, 50 parts by mole of terephthalic acid, 15 parts by mole of isophthalic acid, 30 parts by mole of dodecenylsuccinic acid, and 5 parts by mole of 1,2,4-trimellitic acid are put into a heated and dried two-necked flask as raw materials.

Synthesis of Crystalline Polyester Resin (1)

43.4 parts by mole of dimethyl sebacate, 32.8 parts by mole of 1,10-decanediol, and 27 parts by mole of dimethyl sulfoxide, and 0.03 parts by mole of dibutyl tin oxide as a catalyst are put into a heated and dried three-necked flask, nitrogen gas is introduced into the flask so that the air is changed into an inert atmosphere by a decompression operation, and then 4 hours of mechanical stirring is performed at 180° C. Under the reduced pressure, dimethyl sulfoxide is distilled, the temperature therein is slowly increased to 220° C. under the reduced pressure, stirring is performed for 1.5 hours, and when the contents in the flask become a viscous state, air-cooling is performed and the reaction is stopped, and thus 65 parts by mole of an aliphatic crystalline polyester resin (1) is synthesized.

When the molecular weight is measured in the same manner as that of the amorphous polyester resin (1), the weight average molecular weight (Mw) of the obtained crystalline polyester resin (1) is 22,000. Further, when the melting temperature is measured in the same manner as that of the amorphous polyester resin (1) and the DSC spectrum is obtained, the crystalline polyester resin (1) shows a clear peak and the melting temperature (Tm1) is 77° C.

Preparation of Crystalline Polyester Resin Particle Dispersion 160 parts by weight of the crystalline polyester resin (1), 233 parts by weight of ethyl acetate, and 0.1 parts by weight of sodium hydroxide aqueous solution (0.3 N) are prepared, put into a separable flask, heated at 75° C., and stirred using a Three-one motor (manufactured by Shinto Scientific Co., Ltd.), thereby preparing a resin mixed liquid. The resin mixed liquid is further stirred, 373 parts by weight of ion exchange water is slowly added, phase inversion emulsification is performed, and the temperature is decreased to 40° C. at a temperature dropping rate of 10° C./min, followed by removing the solvent, to thereby obtain a crystalline polyester resin particle dispersion (solid content concentration: 30% by weight).

Preparation of Amorphous Polyester Resin Particle Dispersion 160 parts by weight of the amorphous polyester resin (1), 233 parts by weight of ethyl acetate, and 0.1 parts by weight of sodium hydroxide aqueous solution (0.3 N) are prepared, put into a separable flask, heated at 70° C., and stirred using a Three-one motor (manufactured by Shinto Scientific Co., Ltd.), thereby preparing a resin mixed liquid. The resin mixed liquid is further stirred, 373 parts by weight of ion exchange water is slowly added, phase inversion emulsification is performed, and the temperature is decreased to 40° C. at a temperature dropping rate of 1° C./min, followed by removing the solvent, to thereby obtaining an amorphous polyester resin particle dispersion (solid content concentration: 30% by weight).

Preparation of Colorant Dispersion

Cyan pigment (C. I. Pigment blue 15:3, manufactured by Dainichiseika Color & Chemicals Mfg. Co., Ltd.): 45 parts by weight Ionic surfactant (NEOGEN RK, manufactured by Daiichi Kogyo Seiyaku Co., Ltd.): 5 parts by weight Ion exchange water: 200 parts by weight The above-described components are mixed, dissolved, and dispersed using a homogenizer (IKA ULTRA-TURRAX) for 10 minutes, thereby obtaining a colorant dispersion having a volume average particle diameter of 170 nm.

Preparation of Release Agent Dispersion

Paraffin wax (melting temperature: 69° C., manufactured by Wako Pure Chemical Industries, Ltd.): 45 parts by weight Cationic surfactant (NEOGEN RK, manufactured by Daiichi Kogyo Seiyaku Co., Ltd.): 5 parts by weight Ion exchange water: 200 parts by weight The above-described components are heated at 90° C., sufficiently dispersed using ULTRA-TURRAX T-50 (manufactured by IKA, Inc.), and subjected to a dispersion treatment using a pressure discharge type Gaulin homogenizer, thereby obtaining a release agent dispersion having a volume average particle diameter of 200 nm and a solid content of 24.3% by weight.

Preparation of Toner Particles

Crystalline polyester resin particle dispersion: 15 parts by weight

Amorphous polyester resin particle dispersion: 80 parts by weight

Colorant dispersion: 18 parts by weight

Release agent dispersion: 18 parts by weight

Distilled water is added to the above-described components such that the solid content becomes 16% by weight, and the mixture is sufficiently mixed in a stainless steel flask using an ULTRA-TURRAX T50 and dispersed. Next, 0.4 parts by weight of polyaluminum chloride is added as a coagulant, and a dispersion operation is continued by the ULTRA-TURRAX T50. The flask is stirred in an oil bath for heating and heated to 50° C. The flask is maintained at the same temperature for 1 hour, and 50 parts by weight of an amorphous polyester resin particle dispersion is added thereto. Subsequently, the pH in the system is adjusted to 9.0 by adding 1 mol/L of a sodium hydroxide aqueous solution, the solution is heated to 85° C. while stirring is continued, and the state is held for 3 hours. When the particle diameter is measured at this time, the volume average particle diameter is 3.5 μm. After the reaction is finished, the flask is immersed in water so as to be cooled, the mixture is suctioned and filtered, and then the filtered particles are sufficiently washed with ion exchange water. The obtained filtered cake is re-dispersed in 500 parts by weight of ion exchange water, the mixture is sufficiently stirred, suctioned, and filtered, and the filtered particles are washed with ion exchange water, thereby obtaining a wet cake of coarse toner particles.

The obtained wet cake of coarse toner particles is re-dispersed in 300 parts by weight of distilled water, the pH thereof is adjusted to 4 by adding 1 N of hydrochloric acid, 50 parts by weight of an aqueous solution obtained by dissolving 1 part by weight of 14 to 18 hydrates of aluminum sulfate in 10 parts by weight of distilled water is added thereto, the mixture is continuously stirred for 1 hour at room temperature (20° C. to 25° C.), the mixture is filtered, and then the filtered particles are washed with 1,000 parts by weight of water 5 times.

The wet cake of washed toner particles is re-dispersed in 400 parts by weight of distilled water, the pH thereof is adjusted to 2 by adding 5 parts by weight of 1 N of hydrochloric acid, 20 parts by weight of a 5 wt % aqueous solution of polyethyleneimine (manufactured by JUNSEI CHEMICAL CO., LTD., weight average molecular weight: 70,000) is slowly added dropwise while the mixture is stirred, and the stirring is continued for 1 hour after the addition is finished. After the stirring is finished, the dispersion is suctioned and filtered, and the filtered particles are continuously washed with water. The obtained cake is freeze-dried at 25° C. for 48 hours to thereby collect 90 parts by weight of dry cyan toner particles.

The content of aluminum is measured, the liquid developer is prepared, and the evaluations are performed in the same manner as in Example 1 using the dry cyan toner particles obtained in the above-described manner. The results are shown in Table 1.

Example 6

A treatment using polyethyleneimine is performed in the same manner as in Example 1 except that the amount of an aluminum sulfate aqueous solution to be added is changed to 2 parts by weight in Example 1 to thereby collect 95 parts by weight of dry cyan toner particles.

The content of aluminum is measured, the liquid developer is prepared, and the evaluations are performed in the same manner as in Example 1 using the dry cyan toner particles obtained in the above-described manner. The results are shown in Table 1.

Example 7

The surface treatment is performed using 10 parts by weight of polyallylamine PAA-15C (15 wt % solution, manufactured by Nittobo Medical, Inc., in the formula (I) above, a represents a value of approximately 300 and b represents a value of 0, weight average molecular weight: 15,000) in place of 20 parts by weight of a 5.0 wt % polyethyleneimine aqueous solution (manufactured by JUNSEI CHEMICAL CO., LTD., weight average molecular weight: 70,000) in Example 1 and thus 90 parts by weight of dry cyan toner particles are recovered in the same manner as in Example 1.

The content of aluminum is measured, the liquid developer is prepared, and the evaluations are performed in the same manner as in Example 1 using the dry cyan toner particles obtained in the above-described manner. The results are shown in Table 1.

Example 8

The surface treatment is performed using 10 parts by weight of polyallylamine PAA-1112 (15 wt % solution, manufactured by Nittobo Medical, Inc., in the formula (I) above, a represents a value of 5 to 10 and b represents a value of 5 to 10, and $R^1$ and $R^2$ each represent a methyl group, weight average molecular weight: 1,000) in place of 20 parts by weight of a 5 wt % polyethyleneimine aqueous solution (manufactured by JUNSEI CHEMICAL CO., LTD., weight average molecular weight: 70,000) in Example 1, and thus 90 parts by weight of dry cyan toner particles are collected in the same manner as in Example 1.

The content of aluminum is measured, the liquid developer is prepared, and the evaluations are performed in the same manner as in Example 1 using the dry cyan toner particles obtained in the above-described manner. The results are shown in Table 1.

Example 9

30 parts by weight of the dry cyan toner particles obtained in Example 1 are mixed with 70 parts by weight of silicone oil (KF-96-20cs, manufactured by Shin-Etsu Chemical Co., Ltd.) and 0.1 parts by weight of carboxy-modified silicone oil (X-22-3701E, manufactured by Shin-Etsu Chemical Co., Ltd., in the formula (II) above, X and Y each represent a hydrogen atom, Z represents COOH, $R^3$ and $R^4$ each represent a methylene group, and $R^5$ represents an alkylene group (details unknown), number average molecular weight: 40,000) (compound (II-1)) and thus a liquid developer having a solid content concentration of 30% by weight is obtained. Evaluations are performed as in Example 1. The evaluation results are shown in Table 1.

(II-1)

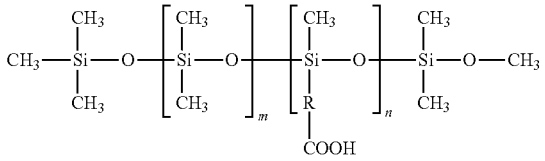

Example 10

30 parts by weight of the dry cyan toner particles obtained in Example 1 are mixed with 70 parts by weight of silicone oil (KF-96-20cs, manufactured by Shin-Etsu Chemical Co., Ltd.) and 0.1 parts by weight of carboxy-modified silicone oil (X-22-3710, manufactured by Shin-Etsu Chemical Co., Ltd., in the formula (II), X represents COOH, Y and Z each represent a hydrogen atom, $R^3$ represents an alkylene group (details unknown), and $R^4$ and $R^5$ each represent a methylene group, number average molecular weight: 1,450) (compound (II-2)) and thus a liquid developer having a solid content concentration of 30% by weight is obtained. Evaluations are performed as in Example 1. The evaluation results are shown in Table 1.

(II-2)

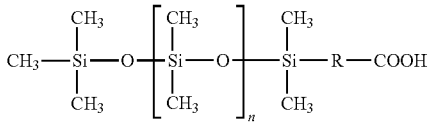

Example 11

30 parts by weight of the dry cyan toner particles obtained in Example 1 are mixed with 70 parts by weight of silicone oil (KF-96-20cs, manufactured by Shin-Etsu Chemical Co., Ltd.) and 0.1 parts by weight of carboxy-modified silicone oil (X-22-162C, manufactured by Shin-Etsu Chemical Co., Ltd., in the formula (II) above, X and Y each represent COOH, Z represents a hydrogen atom, $R^3$ and R4 each represent alkylene group (details unknown), $R^5$ represents a methylene group, number average molecular weight: 4,600) (compound (II-3)) and thus a liquid developer having a solid content concentration of 30% by weight is obtained. Evaluations are performed as in Example 1. The evaluation results are shown in Table 1.

(II-3)

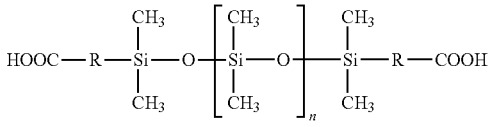

Example 12

30 parts by weight of the dry cyan toner particles obtained in Example 1 are mixed with 70 parts by weight of silicone oil (KF-96-20cs, manufactured by Shin-Etsu Chemical Co., Ltd.) and 0.2 parts by weight of the following compound (III-1) and thus a liquid developer having a solid content concentration of 30% by weight is obtained. Evaluations are performed as in Example 1. The evaluation results are shown in Table 1.

(III-1)

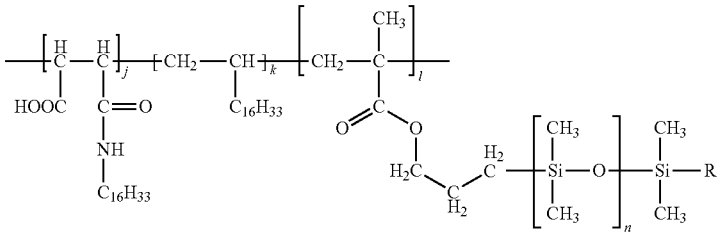

In addition, the compound (III-1) is synthesized as follows.

Synthesis of Precursor 25.5 parts by weight of 1-octadecene, 10 parts by weight of maleic anhydride, and 20 parts by weight of (3-methacryloxy)propylpolydimethylsiloxane (Silaplane FM-0725, manufactured by JNC Corporation) are dissolved in 50 parts by weight of toluene and subjected to nitrogen substitution, the temperature is increased to 70° C. using an oil bath, a solution obtained by dissolving 0.5 parts by weight of benzoyl peroxide in 5 parts by weight of toluene is added thereto, and the solution is stirred at 80° C. for 20 hours. After the reaction is finished, the mixture is poured into 800 parts by weight of 2-propanol, the formed precipitate is suctioned, filtered, and washed with 2-propanol, the pressure thereof is reduced, and the resultant is dried, thereby obtaining 35.5 parts by weight of a precursor (pale yellow solid).

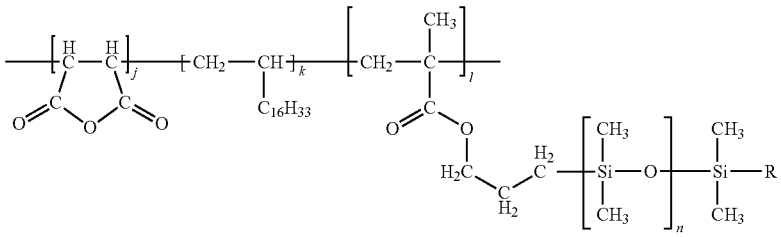

5.5 parts by weight of the above-described precursor, 2.6 parts by weight of hexadecylamine, and 0.1 parts by weight of pyridine are dissolved in 25 parts by weight of xylene, and the mixture is stirred at 130° C. for 20 hours in a nitrogen stream. After the reaction is finished, the mixture is poured into 500 parts by weight of methanol, the formed precipitate is suctioned, filtered, and washed with methanol, the pressure thereof is reduced, and the resultant is dried, thereby obtaining 6.3 parts by weight of a pale yellow solid. When the weight average molecular weight Mw of the obtained compound (III-1) is measured with GPC, the value is 36,000 (in terms of polystyrene).

Example 13

30 parts by weight of dry cyan toner particles obtained in Example 1, 70 parts by weight of silicone oil (KF-96-20cs, manufactured by Shin-Etsu Chemical Co., Ltd.), and 0.1 parts by weight of the following compound (III-2) are mixed with each other, and thus a liquid developer having a solid content concentration of 30% by weight is obtained. The charging characteristics are determined in the same manner as in Example 1. The results thereof are shown in Table 1.

(III-2)

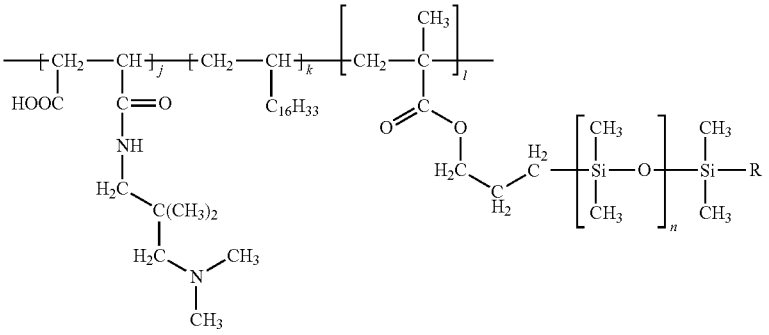

Further, the compound (III-2) is synthesized as follows. 5.5 parts by weight of the precursor used in Example 13, 1.4 parts by weight of N,N-dimethyl-2,2-dimethyl-1,3-propanediamine, and 0.1 parts by weight of pyridine are dissolved in 25 parts by weight of xylene, and the mixture is stirred at 130° C. for 20 hours in a nitrogen stream. After the reaction is finished, the mixture is poured into 300 parts by weight of methanol, the formed precipitate is suctioned, filtered, and washed with methanol, the pressure thereof is reduced, and the resultant is dried, thereby obtaining a pale pink solid as the compound (III-2). When the weight average molecular weight Mw of the obtained compound (III-2) is measured with GPC, the value is 33,000 (in terms of polystyrene).

Comparative Example 1

The wet cake of coarse toner particles obtained in Example 1 is re-dispersed in 400 parts by weight of distilled water without performing an immersion treatment with an aluminum compound, the pH thereof is adjusted to 2 by adding 5 parts by weight of 1 N of hydrochloric acid, 20 parts by weight of a 5 wt % aqueous solution of polyethyleneimine (manufactured by JUNSEI CHEMICAL CO., LTD., weight average molecular weight: 70,000) is slowly added dropwise while the mixture is stirred, and the stirring is continued for 1 hour after the addition is finished. After the stirring is finished, the dispersion is suctioned and filtered, and the filtered particles are continuously washed with water. The obtained cake is freeze-dried at 25° C. for 48 hours to thereby collect 95 parts by weight of dry cyan toner particles.

The content of aluminum is measured, the liquid developer is prepared, and the evaluations are performed in the same manner as in Example 1 using the dry cyan toner particles obtained in the above-described manner. The results are shown in Table 1.

Comparative Example 2

The wet cake of coarse toner particles obtained in Example 3 is subjected to a treatment using polyethyleneimine in the same manner as in Comparative Example 1 without performing an immersion treatment with an aluminum compound, and thus 90 parts by weight of dry magenta toner particles are collected.

The content of aluminum is measured, the liquid developer is prepared, and the evaluations are performed in the same manner as in Example 1 using the dry magenta toner particles obtained in the above-described manner. The results are shown in Table 1.

Comparative Example 3

The wet cake of coarse toner particles obtained in Example 5 is subjected to a treatment using polyethyleneimine in the same manner as in Comparative Example 1 without performing an immersion treatment with an aluminum compound, and thus 90 parts by weight of dry cyan toner particles are collected.

The content of aluminum is measured, the liquid developer is prepared, and the evaluations are performed in the same manner as in Example 1 using the dry cyan toner particles obtained in the above-described manner. The results are shown in Table 1. Further, polyaluminum chloride is used as a coagulant when the toner particles of Example 5 are prepared. The content of aluminum in the toner particles is 0.009% by weight of total elements.

Comparative Example 4

A treatment using polyethyleneimine is performed in the same manner as in Example 1 except that the amount of an aluminum sulfate aqueous solution to be added is changed to 80 parts by weight in Example 1, and thus 95 parts by weight of dry cyan toner particles are collected.

The content of aluminum is measured, the liquid developer is prepared, and the evaluations are performed in the same manner as in Example 1 using the dry cyan toner particles obtained in the above-described manner. The results are shown in Table 1.

Comparative Example 5

A treatment using polyethyleneimine is performed in the same manner as in Example 1 except that the amount of an aluminum sulfate aqueous solution to be added is changed to 0.3 parts by weight in Example 1, and thus 95 parts by weight of dry cyan toner particles are collected.

The content of aluminum is measured, the liquid developer is prepared, and the evaluations are performed in the same manner as in Example 1 using the dry cyan toner particles obtained in the above-described manner. The results are shown in Table 1.

TABLE 1

| | Al compound | Al content [% by weight] | Surface treatment | Additive | Surface potential [V] | Evaluation of image quality | Positive charging properties |
|---|---|---|---|---|---|---|---|
| Example 1 | Aluminum sulfate | 0.043 | polyethyleneimine | — | 28.9 | A | + |
| Example 2 | Aluminum chloride | 0.073 | polyethyleneimine | — | 25.5 | A | + |
| Example 3 | Aluminum sulfate | 0.048 | polyethyleneimine | — | 26.4 | A | + |
| Example 4 | Aluminum chloride | 0.065 | polyethyleneimine | — | 24.5 | A | + |
| Example 5 | Aluminum sulfate | 0.050 | polyethyleneimine | — | 31.0 | A | + |
| Example 6 | Aluminum sulfate | 0.090 | polyethyleneimine | — | 27.7 | A | + |
| Example 7 | Aluminum sulfate | 0.043 | PAA-15C | — | 23.5 | A | + |
| Example 8 | Aluminum sulfate | 0.043 | PAA-1112 | — | 29.2 | A | + |
| Example 9 | Aluminum sulfate | 0.043 | polyethyleneimine | Compound (II-1) | 25.5 | A | + |
| Example 10 | Aluminum sulfate | 0.043 | polyethyleneimine | Compound (II-2) | 26.7 | A | + |
| Example 11 | Aluminum sulfate | 0.043 | polyethyleneimine | Compound (II-3) | 25.1 | A | + |
| Example 12 | Aluminum sulfate | 0.043 | polyethyleneimine | Compound (III-1) | 27.1 | A | + |
| Example 13 | Aluminum sulfate | 0.043 | polyethyleneimine | Compound (III-2) | 28.7 | A | + |
| Comparative Example 1 | — | Lower than or equal to detection limit | polyethyleneimine | — | 17.5 | C | ± |
| Comparative Example 2 | — | Lower than or equal to detection limit | polyethyleneimine | — | 16.2 | C | ± |
| Comparative Example 3 | — | 0.009 | polyethyleneimine | — | 15.6 | B | + |
| Comparative Example 4 | Aluminum sulfate | 0.130 | polyethyleneimine | — | 18.8 | B | + |
| Comparative Example 5 | Aluminum sulfate | 0.025 | polyethyleneimine | — | 20.2 | B | + |

In this manner, in Examples in which a liquid developer containing toner particles whose content of aluminum therein which is measured by fluorescent X-ray analysis is in the range of from 0.04% by weight to 0.1% by weight of total elements is used, the charge maintaining properties are improved compared to Comparative Examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A liquid developer comprising:

a carrier liquid; and a toner particle which contains a binder resin, wherein the toner particles have a content of aluminum measured by fluorescent X-ray analysis in a range of from 0.04% by weight to 0.1% by weight of total elements, wherein the binder resin contains a polyester resin, wherein the toner particles are surface-treated by a polyamine, and wherein the polyamine is polyallylamine represented by the following formula (I):

(I)

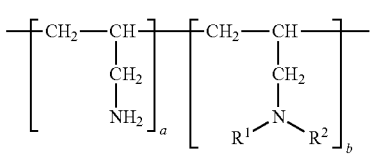

wherein $R^1$ and $R^2$ each independently represent a hydrogen atom or an aliphatic hydrocarbon group having 1 to 20 carbon atoms and a and b each independently represent an integer of 100 to 1,000.

2. The liquid developer according to claim 1, wherein the toner particles are immersion-treated by a solution containing an aluminum compound.

3. The liquid developer according to claim 1, wherein the carrier liquid contains a carboxyl group-containing silicone compound.

4. The liquid developer according to claim 3, wherein the carboxyl group-containing silicone compound is a compound represented by the following formula (II):

(II)

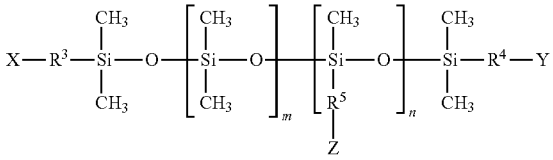

wherein X, Y, and Z each independently represent a hydrogen atom or a carboxyl group; at least one of X, Y, and Z represents a carboxyl group; m represents an integer of 1 to 1,000; n represents an integer of 1 to 10; and $R^3$, $R^4$, and $R^5$ each independently represent a single bond or a divalent aliphatic hydrocarbon group having 1 to 20 carbon atoms.

5. The liquid developer according to claim 1, wherein the carrier liquid contains a copolymer represented by the following formula (III):

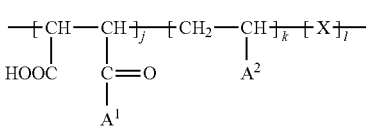

(III)

wherein $A^1$ represents $NR^1R^2$ or $OR^1$; $R^1$ and $R^2$ each independently represent a hydrogen atom or an aliphatic or aromatic hydrocarbon group which may be substituted and has 1 to 20 carbon atoms; $A^2$ represents $R^3$ or $OR^3$; $R^3$ represents an aliphatic or aromatic hydrocarbon group which may be substituted and has 1 to 20 carbon atoms; X represents a divalent organic group having a polysiloxane structure in a main chain or a side chain thereof; j and k each independently represent an integer of 1 to 1,000; and l represents an integer of 1 to 100.

6. The liquid developer according to claim 1, wherein the toner particles are obtained by aggregating resin particles containing a binder resin in an aqueous medium.

7. A developer cartridge which is detachable from an image forming apparatus, comprising the container storing the liquid developer according to claim 1.

8. The developer cartridge according to claim 7, wherein the toner particles of the liquid developer are immersion-treated by a solution containing an aluminum compound.

9. An image forming apparatus comprising:

an image holding member;

a charging unit that charges a surface of the image holding member;

a latent image forming unit that forms a latent image on the surface of the image holding member;

a developing unit that develops the latent image formed on the surface of the image holding member using the liquid developer according to claim 1 to form a toner image;

a transfer unit that transfers the toner image formed on the surface of the image holding member onto a recording medium; and a fixing unit that fixes the toner image transferred to the recording medium to form a fixed image.

10. The image forming apparatus according to claim 9, wherein the toner particles of the liquid developer are immersion-treated by a solution containing an aluminum compound.

* * * * *